United States Patent [19]

Mondek

[11] Patent Number: 4,778,418

[45] Date of Patent: Oct. 18, 1988

[54] TIE BAR FOR MARINE PROPULSION DEVICES

[75] Inventor: Martin J. Mondek, Wonder Lake, Ill.

[73] Assignee: Outboard Marine Corporation, Waukegan, Ill.

[21] Appl. No.: 91,584

[22] Filed: Aug. 31, 1987

[51] Int. Cl.[4] ..... B63H 5/12

[52] U.S. Cl. ..... 440/63; 74/480 B

[58] Field of Search ..... 440/53, 58, 59–63; 114/144 R; 74/480 B, 484, 492

[56] References Cited

U.S. PATENT DOCUMENTS

| | | | |
|---|---|---|---|
| 1,454,973 | 5/1923 | Malloy, Jr. . | |
| 2,968,192 | 1/1961 | Fletcher | 74/480 B |
| 2,999,476 | 9/1961 | Johnson | 440/63 |
| 3,197,191 | 7/1965 | Axthammer | 267/64 |
| 3,339,680 | 9/1967 | Tuneblom | 188/96 |
| 3,756,186 | 9/1973 | Nordling | 440/63 |
| 4,300,888 | 11/1981 | Warning | 440/62 |
| 4,310,320 | 1/1982 | Pitchford | 440/61 |
| 4,311,471 | 1/1982 | Queen | 440/63 |
| 4,416,636 | 11/1983 | Boda | 440/51 |
| 4,557,696 | 12/1985 | Nakahama | 440/61 |

*Primary Examiner*—Sherman D. Basinger
*Assistant Examiner*—Jesüs D. Sotelo
*Attorney, Agent, or Firm*—Michael, Best & Friedrich

[57] ABSTRACT

Disclosed herein is a tie bar for connecting a pair of marine propulsion devices which are respectively pivotable about spaced vertical axes for steering and about a common horizontal axis for tilting, which tie bar includes structure for selectively affording axial extension of the tie bar in response to tilting movement of one of the propulsion devices relative to the other of the propulsion devices and for preventing axial extension of the tie bar during normal steering movements.

24 Claims, 2 Drawing Sheets

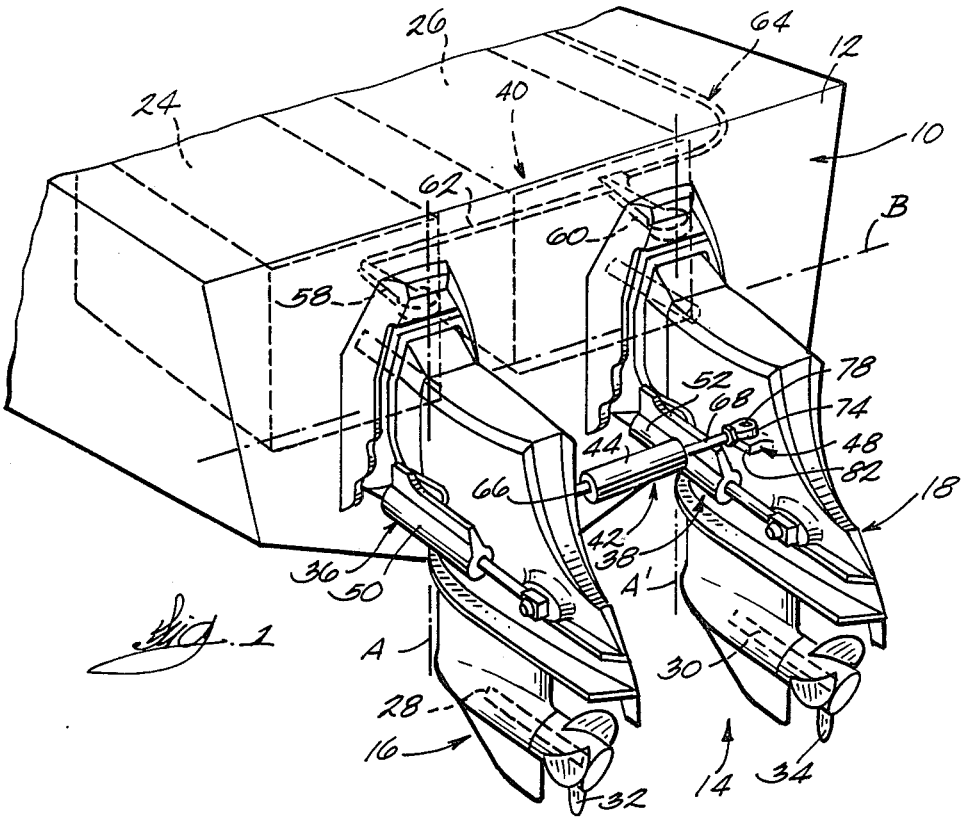
Fig. 1
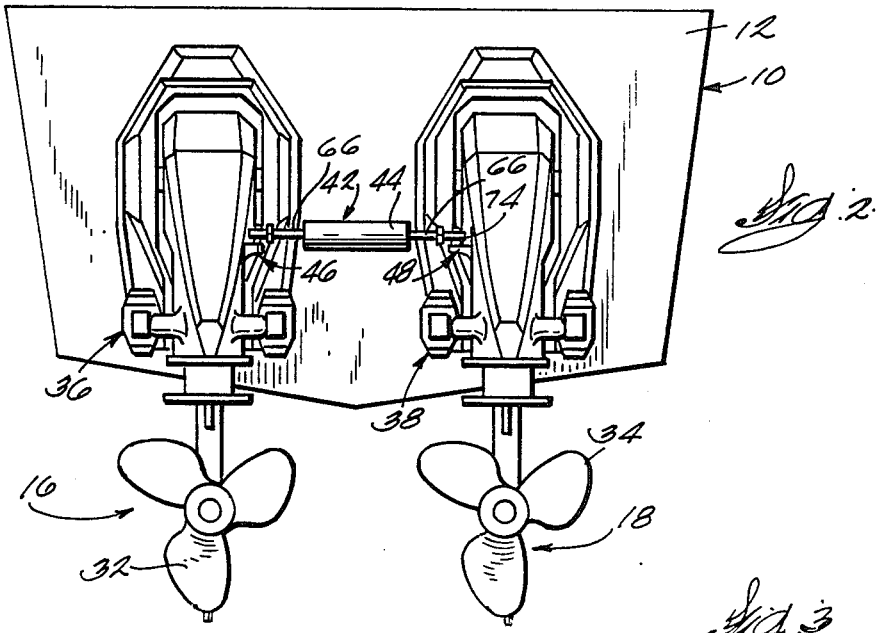
Fig. 2
Fig. 3
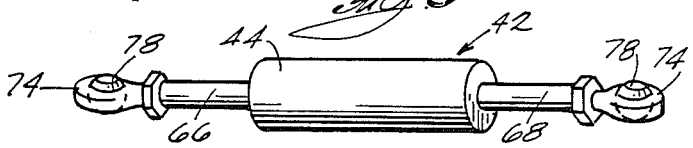

TIE BAR FOR MARINE PROPULSION DEVICES

BACKGROUND OF THE INVENTION

The invention relates to external connectors, or tie bars, for connecting two marine propulsion devices. Such tie bars aid in keeping the propulsion devices in parallel relation when they are subjected to steering torque or other hydrodynamic forces.

It would be desirable to have two drive units connected by a tie bar outboard of the boat and still be able to tilt either drive unit to its full tilt up position while maintaining the other drive unit in the full down position if, for instance, the other drive unit were disabled and the associated water craft must be brought back to the harbor on one engine.

In the past, tie bars have generally been nonextendable once they were adjusted to the proper length between a pair of mounted marine propulsion devices. For example, the devices depicted in U.S. Pat. Nos. 3,756,186 and 4,311,471 have such a characteristic.

Since their length was fixed, devices such as those shown in the prior art generally did not allow for the upward tilting of one marine propulsion device with respect to the other device without rotation of one unit relative to another unit about a vertical axis.

One exception is found in U.S. Pat. No. 4,311,471, especially FIGS. 5 and 6, where the two propulsion units are not positioned so as to rotate about coaxial horizontal axes, but are instead displaced vertically on the transom. The two propulsion units are in alignment to drive the boat forward when the lower unit is tilted either up or down because the tie bar ends up at an equal angle above or below the horizontal. It can be appreciated that if the upper unit were attempted to be tilted upwardly while the lower unit is in the down position, there would have to be relative rotation of the units about their vertical axes. Moreover, if both units were mounted on the transom about coincident axes, neither could be tilted without relative rotation about their vertical axes.

One attempt to provide means to solve this problem is found in U.S. Pat. No. 4,310,320. In this patent an electrical system is described which contains a control circuitry which requires both drive units to be tilted up or down after a certain angle of tilt.

Attention is also directed to the following patents:

U.S. Pat. No. 1,454,973
U.S. Pat. No. 3,197,191
U.S. Pat. No. 4,416,636
U.S. Pat. No. 4,300,888
U.S. Pat. No. 3,339,680

SUMMARY OF THE INVENTION

The invention provides a tie bar for connecting a pair of marine propulsion devices which are respectively pivotable about spaced vertical axes for steering and about a common horizontal axis for tilting. The tie bar includes means for affording axial extension of the tie bar in response to relative tilting rotation of the propulsion devices about the horizontal axis and for preventing axial extension of the tie bar during normal steering movement of the propulsion units about the vertical axes.

In one embodiment of the invention, the means for affording and preventing axial extension comprises a pneumatic system containing a compressible fluid. The pneumatic system comprises a cylinder having therein a piston dividing the cylinder into two chambers, with one of the chambers containing the compressible fluid.

In one embodiment of the invention, the compressible fluid is pressurized and the pneumatic system further includes means for adjusting the pressure of the compressible fluid.

In another embodiment of the invention, the means for affording and preventing axial extension comprises a mechanical system having an extendible spring. The extendible spring has a spring constant and the mechanical system further comprises means for adjusting the spring constant.

In one embodiment of the invention, the means for affording and preventing axial extension comprises a hydraulic system containing an incompressible fluid. The hydraulic system also comprises a cylinder having therein a piston dividing the cylinder into two chambers with at least one of the chambers containing the incompressible fluid. The hydraulic system also comprises a relief valve which affords fluid flow from one of the chambers to the other of the chambers when the fluid pressure in the one chamber exceeds a predetermined level.

In another embodiment of the invention, the means for affording and preventing axial extension comprises a hydraulic system containing an incompressible fluid. This hydraulic system further comprises a cylinder having therein a piston dividing said cylinder into two chambers with at least one of said chambers containing the incompressible fluid. In addition, the hydraulic system comprises a rotary valve means for affording flow of the incompressible fluid from one of the chambers to the other of the chambers in response to rotation of the piston with respect to the cylinder.

The invention also provides a marine propulsion system comprising a pair of drive units, which are pivotable about a horizontal axis for tilting and about respective and spaced vertical axes for steering, a pair tilting means for pivoting the drive units about the horizontal axis, steering means for pivoting the drive units about the vertical axes, and a tie bar. The tie bar includes means for affording axial extension of the tie bar in response to relative rotation of the drive units about the horizontal axis and for preventing axial extension of the tie bar during normal steering movement of the propulsion units about the vertical axes.

In one embodiment of the invention, the marine propulsion system further comprises a tie bar having a length adjustment means for selectively adjusting and setting the minimum axial length of the tie bar.

In one embodiment of the invention, the steering means includes a tiller arm connected to each drive unit and means for moving the tiller arm.

In one embodiment of the invention, each tilting means comprises a hydraulic cylinder.

In one embodiment of the invention, the force exerted by the actuation of each tilting means is greater than the force exerted by the steering means.

In one embodiment of the invention, the means for affording and preventing axial extension comprises a pneumatic system, which pneumatic system contains a compressible fluid and also comprises a cylinder having therein a piston dividing the cylinder into two chambers, with one of the chambers containing the compressible fluid. The force exerted on the piston by the compressible fluid is greater than the force exerted by the actuation of the steering means and less than the force exerted by the actuation of one of the tilting means.

In one embodiment of the invention, the marine propulsion system further comprises an adjustment means for selectively adjusting the force exerted on the piston by the compressible fluid.

In one embodiment of the invention, the means for affording and preventing axial extension comprises a mechanical system having an extendible spring. The extendible spring has a spring constant. The force needed to extend the spring is greater than the force exerted by the actuation of the steering means and less than the force exerted by the actuation of one of the tilting means.

In one embodiment of the invention, the propulsion system further comprises a spring constant adjustment means for selectively adjusting and setting the spring constant.

In one embodiment of the invention, the means for affording and preventing axial extension comprises a hydraulic system which contains an incompressible fluid and further comprises a cylinder having therein a piston dividing the cylinder into two chambers. A relief valve affords flow of the incompressible fluid from one of the chambers to the other of the chambers when the pressure in the one chamber exceeds a predetermined level.

A principal feature of the invention is to provide a device that aids in maintaining the propeller shafts of a pair of marine propulsion devices fixed in a parallel toe in or toe out relation while the boat is being steered or the propulsion units are being subjected to typical hydrodynamic forces as the boat passes through the water, but which will extend to allow for tilting of either of the drive units relative to the other drive unit. Other features and advantages of the invention will become apparent to those skilled in the art upon review of the following detailed description, claims, and drawings.

DESCRIPTION OF THE DRAWINGS

FIG. 1 is a rear perspective view of a marine propulsion system having a tie bar incorporating various of the features of the invention.

FIG. 2 is a rear elevation view of the marine propulsion system shown in FIG. 1.

FIG. 3 is a detail of the tie bar incorporated in the marine propulsion system shown in FIG. 1.

Figure 4:
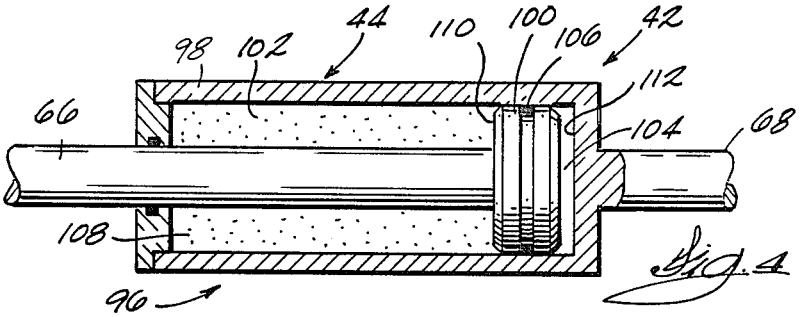
FIG. 4 is a cut away view of an extension link which incorporates a pneumatic system and which can be employed in the marine propulsion system of FIG. 1.

Before explaining the invention in detail, it is to be understood that the invention is not limited in its application to the details of construction and arrangement of parts set forth in the following general description or illustrated in the accompanying drawings, since the invention is capable of other embodiments and of being practiced or carried out in various ways. Also, it is to be understood that the phraseology or terminology employed herein is for the purpose of description and not of limitation.

GENERAL DESCRIPTION

FIG. 1 illustrates a boat 10 with a generally vertical transom 12 having a marine propulsion system 14 comprising a pair of propulsion or drive units 16 and 18 in side-by-side relation, mounted on the transom 12, and equally spaced from the centerline of the boat 10. In the embodiment shown, the propulsion units 16 and 18 comprise stern drives which are connected to prime movers such as internal combustion engines 24 and 26 which comprise respective drive shaft housings including sides, and which drive propeller shafts 28 nd 30 which are connected, at their aft ends, to a pair of propellers 32 and 34. Each propulsion unit 16 and 18 also contains means 36 and 38 for tilting the respective stern drive unit about generally coaxial horizontal axes "B". In addition, the propulsion system 14 comprises means 40 for steering the boat by pivoting the stern drive units about generally parallel vertical axes A′ and A″. The propulsion units are connected outboard of the transom by means of a tie bar 42 which will be discussed in more detail hereafter.

Although a pair of stern drives is depicted in the drawings, it should be understood that in addition to stern drive units, the present invention is equally applicable to a pair of outboard motors, a pair of OMC Sea Drive marine propulsion units, or a pair of surface drive units, as long as the marine propulsion system 14 has a portion outboard of the boat that is characterized by the ability to pivot about both horizontal and vertical axes. Moreover, it should be understood that the invention can be practiced when three or more such devices are attached to one transom, by connecting each propulsion device with its adjacent device by means of a tie bar.

The propulsion devices 16 and 18 shown in FIGS. 1 and 2 are connected to each other by a tie bar 42 having means which affords and prevents axial extension of the tie bar 42 and which can comprise a link 44. The tie bar 42 is attached to each of the propulsion units by attachment means 46 and 48 which are positioned somewhere near the aft end of each unit. The extension means or link 44 allows the length of the tie bar 42 to increase when only one of the propulsion devices 16 or 18 is tilted from the lower run position to the upper tilt position and to retain or return to the shortened condition when both units are in either the lower run position or the upper tilt position.

When the propulsion devices 16 and 18 are in a similar angular relation with respect to axis B, the tie bar 42 assumes a generally horizontal orientation between the two propulsion units 16 and 18. As one propulsion unit is tilted upwardly with respect to the other propulsion unit, the tie bar 42 will assume an angular orientation with respect to the horizontal. In addition, as the one propulsion unit 16 is being raised relative to the other unit 18, the attachment means 48 on the tilting propulsion unit 18 will rotate around an axis running longitudinally through the tie bar with respect to the attachment means 46.

However, when either propulsion unit 16 or 18 is rotated about its vertical axis A′ or A″, as when changing the course of the associated boat by suitable steering means, the tie bar 42 will force the other propulsion unit to also rotate about its vertical axis causing the propulsion units 20 and 22 to keep their propeller shafts 28 and 30 in parallel, toe in or toe out alignment. Also, the extension link 44 of the tie bar 42 will resist extension due to normal hydrodynamic forces exerted on the propulsion units 16 and 18 as they pass through the water.

The propulsion units 16 and 18 respectively include tilting means 36 and 38 for tilting the propulsion units 16 and 18 about the horizontal axis B. In a preferred embodiment, each tilting means comprises a pair of hydraulic cylinders 50 and 52, respectively, and an actuating means (not shown) for extending and contracting the hydraulic cylinders. The actuating means may comprise a hydraulic pump and remotely controlled valves. Each of the drive units 16 and 18 will rise or tilt upwardly when hydraulic fluid forces the hydraulic cylinders to extend. It can be appreciated that large stern drive units are quite heavy and the hydraulic cylinders for tilting these units will develop considerable force.

As stated earlier, the propulsion units 16 and 18 are made to pivot about their vertical axes A' and A" by suitable steering means 40. In the embodiment shown, this steering means 40 comprises tiller arms 58 and 60 respectively extending generally horizontally forwardly from the propulsion units inside of the boat 10, a tiller arm connecting bar 62 and a steering actuator 64 connected to one or both of the tiller arms or the connecting bar 62. The steering actuator 64 can comprise any one of a number of known systems including a pull-pull cable system, a push-pull cable system, or a hydraulically actuated system. When the operator of the boat 10 turns a steering wheel (not shown), the steering actuator 64 will move laterally causing the connected tiller arms 58 and 60 to rotate about their respective vertical axes A' and A". The tiller arms, in turn, cause rotational movement of the propulsion units 16 and 18 and their respective propeller shafts 28 and 30 about these vertical axes. In the propulsion units 16 and 18 depicted in FIGS. 1 and 2, the tiller arms will remain generally horizontal when the drive units are tilted either up or down; however, in other marine propulsion systems, the tiller arms may rotate about the horizontal axis "B".

In addition to connecting the marine propulsion units 16 and 18 by means of an inboard tiller arm connecting bar 62, it has been found that the propulsion devices will be able to maintain more accurate alignment if they are also connected by an outboard tie bar 42 which can be positioned in closer proximity to the propeller shafts and have a longer moment arm with respect to axes A' and A".

In a preferred embodiment, the tie bar 42 comprises a pair of rods 66 and 68, with each rod respectively terminating at its outer extremity in connecting means. The connecting means are respectively connected to the drive units or stern drives 16 or 18 by the respective attachment means 46 or 48. It can be appreciated that one rod may be shortened or eliminated if the other rod or the extension means 44 is lengthened. In one embodiment, each connecting means comprises a hollow rod end or socket 74 and each attachment means 46 and 48 comprises a spherically shaped post or ball 78 which is sized to fit in the complementary socket 74 with the socket 74 covering a major portion of the ball 78. Each ball 78 is positioned on a ledge 82 which extends toward the centerline of the boat from an inside rearward location on the stern drive. The ledges 82 allow the sockets 74 to articulate about the balls 78 without interference with the balls except at the bottom where the ball is attached to the ledge. In one embodiment, the bottom of the socket 74 is cut out in certain areas to allow for small angular and rotational movement of the socket 74 with respect to the ball 78 in some directions without binding, while causing binding and the resultant axial rotation of one rod 66 with respect to the other rod 68 when one propulsion unit is being tilted with respect to the other.

The sockets 74 and the balls 78 constitute components of respective universal joints connecting the tie bar ends and the sides of the drive shaft housings of the drive units 16 and 18.

The inside end of each rod 66 and 68 is connected to the extension means or link 44 which affords tie bar extension and which will be described in detail in the various embodiments disclosed later herein. In a preferred embodiment, at least one rod, in its connection with the extension link 44, also contains length adjustment means 86 for adjusting and locking the total length of the tie bar (see FIGS. 5 through 8). The length adjustment means 86 comprises, on the rod 68, a threaded end 88 which is threaded into a threaded bore 90 attached to one end of the extension link 44. The adjustment means 86 may also include locking means such as a lock nut 92 for maintaining the set length of the tie bar 42.

When the propulsion units have been installed on the boat 10, the rod 68 is screwed into the bore 90 so that the total length of the tie bar is the same as the distance between the specific pair of propulsion units, as mounted on the transom, and so that the propeller shafts 28 and 30 are generally parallel or have a slight toe-in or toe out. This precise length can be maintained by turning the lock nut 92 down onto the end wall 94 of the extension link 44 to stop movement of the rod 68 relative to the extension link 44. In this way, the adjustment means allows the length of the tie bar assembly 42 to be initially adjusted when installed on the propulsion system.

As seen in FIGS. 4 through 7, the extension means or link 44 can comprise any type of mechanical, pneumatic or hydraulic system, or combination of the above, which will allow the tie bar 42 to maintain a constant length during application to the tie bar of an axial force up to and below a predetermined amount and to allow for extension of the tie bar 42 when the axial force exceeds the predetermined amount. Alternatively, as seen in FIG. 8, the extension means or link 44 can also be any means, such as hydraulic means, which will maintain a constant tie bar length when the two rods are in a certain rotational orientation with respect to an axis running through the rods and which permits axial extension of the tie bar in another rotational orientation of the rods.

Figure 5:
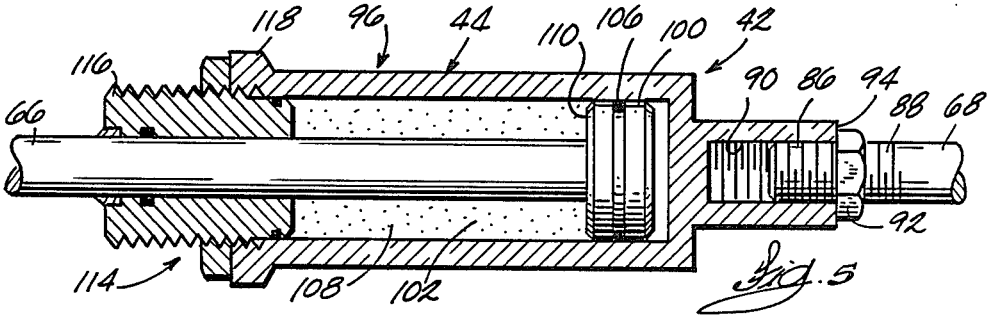
FIG. 5 is a cut away view of an extension link having a pneumatic system and a spring rate adjuster.

In one embodiment, as seen in FIGS. 4 and 5, the extension means comprises a pneumatic system 96. This system comprises a cylinder 98 attached to one rod 68 and a piston 100 attached to the other rod 66. The piston divides the cylinder into a first chamber 102 and second chamber 104. Circumferentially placed around the piston is a seal 106 which effectively eliminates any communication between the chambers. Located within the first chamber 102 is the rod 66 which is attached to the piston 100, together with a predetermined volume of a compressible fluid 108, such as an inert gas. The second chamber 104 is vacated. The volume of gas tends to exert pressure on the rod end 110 of the piston driving the piston toward the end wall 112 of the cylinder, thus bottoming out the piston 100 against the end wall 112. When the piston is bottomed out, the minimum length of the tie bar is set. As seen in FIG. 5, and described above, this minimum length can be adjusted and locked by the length adjustment means 86.

The amount of pressure exerted on the rod side of the piston varies directly with the amount of gas 108 injected into the first chamber 102. This pressure is calculated to be more than the axial force exerted on the tie bar 42 when normal steering forces or hydrodynamic forces, caused by the movement of the propulsion units through the water, are being placed on the propulsion units, but less than the axial force exerted on the tie bar 42 when one of the propulsion units is tilted relative to the other propulsion unit by activation of only one of the two tilt means 36 or 38.

As also seen in FIG. 5, the extension means 44 can also comprise means 114 for adjusting the pressure of the compressible fluid 108 on the rod end 110 of the piston rod, which adjustment, in effect, varies the spring rate of the compressible gas. In one embodiment, this adjustment means 114 comprises a threaded end cap 116 screwed on the end 118 of the cylinder adjacent the first chamber 102 which regulates the volume of the first chamber 102. By adjusting the volume of the chamber 102, the pressure of the compressible fluid 108 on the piston 100 can be adjusted so that the piston will only be allowed to move from its bottomed out position upon the application of a tilting force greater than the normally applied steering force, and not upon the application of a steering force.

Figure 6:
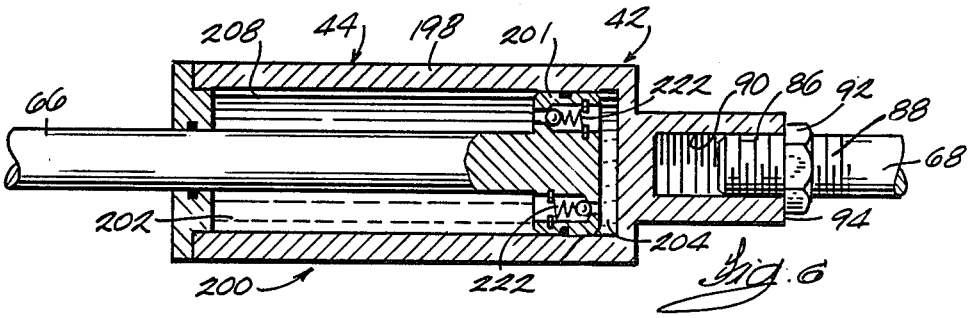
FIG. 6 is a cut away view of an extension link having a hydraulic system with relief valves.

As seen in FIG. 6, in another embodiment, the extension means or link 44 comprises a hydraulic system 200. As in the pneumatic system 96, the hydraulic system 200 also comprises a cylinder 198 which is separated into a first chamber 202 and second chamber 204 by a piston 201. The cylinder 198 is attached to one rod 68 and the piston 101 is attached to the rod 66, with each rod, in turn respectively attached to one of the stern drives 16 and 18 as described above.

In this embodiment, the chambers 202 and 204 are both filled with an incompressible fluid 208, such as hydraulic fluid. The piston 201 contains a two-way relief valve 222 which allows flow of hydraulic fluid 208 from one side of the piston 201 to the other side of the piston 201 upon the exertion of a predetermined force on the piston rod. Again, the relief valve 222 is set to allow flow only above a predetermined force. This force is set so that the tie bar 42 will be allowed to elongate upon the exertion of a tilting torque, but it will not elongate upon the exertion of a lower steering torque. As can be appreciated, the tie bar 42 incorporating the hydraulic system 200 does not constantly try to minimize its length, as in the pneumatic system. However, when set at any length, this system will tend to remain at that length until a force greater than the predetermined relief force is exerted axially on the tie bar. Again, this system may include a means 86 for adjusting the overall length of the tie bar 42.

Figure 7:
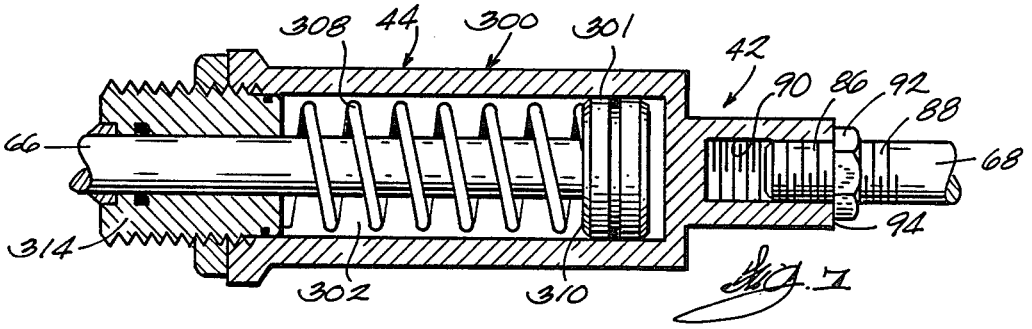
FIG. 7 is a cut away view of an extension link having a mechanical system and a spring rate adjuster.
Figure 8:
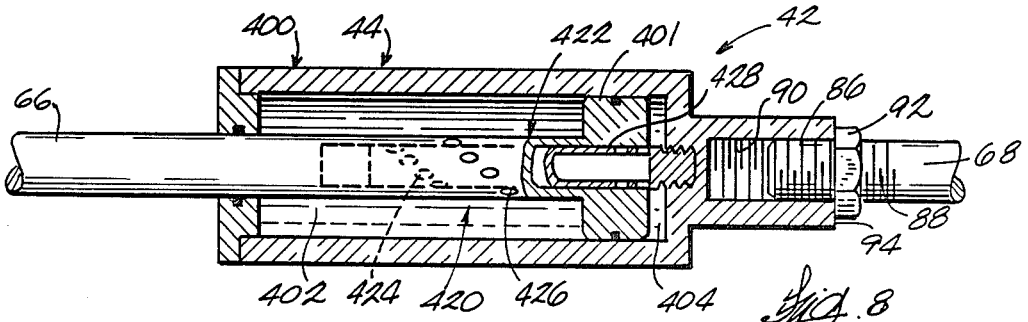
FIG. 8 is a cut away view of an extension link having a hydraulic system with a rotary valve.

As seen in FIG. 7, the extension means or link 44 can also include a mechanical system 300, including a spring 308 captured in a first chamber 302 and exerting force against the face of a spring rate adjustment means 314 and the rod end 310 of the piston 301. As in the other systems, the spring constant of the spring 308 is determined so that it allows for extension of the tie bar 42 upon the exertion of a tilting torque force, but does not allow extension of the tie bar upon the exertion of a steering torque force.

In another embodiment, as seen in FIG. 8, the extension means or link 44 comprises a valved hydraulic system 400 including a manual valve means 420 for selectively allowing fluid to pass from a first chamber 402 to a second chamber 404. The manual valve means 420 comprises a rotary valve 422 comprising two sets 424 and 426 of apertures which become aligned by the rotation of one of the rods 66 and 68 with respect to the other of the rods 66 and 68 to control the flow of hydraulic fluid from one chamber 402 to the other chamber 404.

When one drive unit is tilted with respect to the other unit, not only does the relative position of the connecting means of the tie bar 44 of that drive unit rise with respect to the connecting means of the other drive unit, but the connecting means associated with the risen propulsion unit also experiences rotation due to the lower portion of the socket 74 contacting the bottom of the associated post or ball 78. The rod attached to the connecting means that is tilting will also rotate along an axis running through the tie bar. This rotation opens the rotary valve 422 by causing the set of apertures in the (piston) rod 66 to register with a set of apertures 426 in a tube 428 which is fixed in the cylinder 480 and extends into the (piston) rod 66. The registration of the apertures 424 and 426 allows the hydraulic fluid to pass from one side of the piston 401 to the other. In this way, the extension means or link 44 does not hinder the upward tilting of the drive unit as long as the (piston) rod 66 and the tube 428 are rotated so that their apertures are in alignment. However, when the rotary valve 422 is closed i.e., when the apertures are not aligned, the tie bar 42 will maintain a fixed length.

Other features and advantages of the invention are set forth in the following claims.

I claim:

1. A tie bar for connecting a pair of marine propulsion devices which are respectively pivotable about spaced vertical axes for steering and about a common horizontal axis for tilting, said tie bar having opposite ends, a component of a universal joint attached to each of said opposite ends and adapted to cooperate with another component on the marine propulsion devices, and means spaced inwardly from said opposite ends for affording axial tie bar extension in response to relative tilting rotation of the propulsion devices about the horizontal axis and for preventing axial extension of said tie bar during normal steering movements of the propulsion devices about the vertical axes.

2. A tie bar as set forth in claim 1 wherein said means for affording and preventing axial extension comprises a mechanical system.

3. A tie bar as set forth in claim 2 wherein said mechanical system comprises an extendible spring.

4. A tie bar as set forth in claim 3 wherein said extendible spring has a spring constant and said mechanical system further comprises means for adjusting the spring constant.

5. A tie bar for connecting a pair of marine propulsion devices which are respectively pivotable about spaced vertical axes for steering and about a common horizontal axis for tilting, said tie bar having means for affording axial tie bar extension in response to relative tilting rotation of the propulsion devices about the horizontal axis and for preventing axial extension of said tie bar during normal steering movements of the propulsion devices about the vertical axes, said means for affording and preventing axial extension comprising a hydraulic system containing an incompressible fluid.

6. A tie bar as set forth in claim 5 wherein said hydraulic system comprises a cylinder having therein a piston dividing said cylinder into two chambers with at least one of said chambers containing incompressible fluid, said system also including a relief valve affording fluid flow from one of said chambers to the other of said chambers when the fluid pressure in said one chamber exceeds a predetermined level.

7. A tie bar as set forth in claim 5 wherein said hydraulic system comprises a cylinder having therein a piston dividing said cylinder into two chambers with at least one of said chambers containing incompressible fluid, said system also including a rotary valve affording flow of the incompressible fluid from one of said chambers to the other of said chambers in response to relative rotation between said piston and said cylinder.

8. A tie bar for connecting a pair of marine propulsion devices which are respectively pivotable about spaced vertical axes for steering and about a common horizontal axis for tilting, said tie bar having means for affording axial tie bar extension in response to relative tilting rotation of the propulsion devices about the horizontal axis and for preventing axial extension of said tie bar during normal steering movement of the propulsion devices about the vertical axes, said means for affording and preventing axial extension comprising a pneumatic system containing a compressible fluid.

9. A tie bar as set forth in claim 8 wherein said pneumatic system comprises a cylinder having therein a piston dividing said cylinder into two chambers, with one of said chambers containing said compressible fluid.

10. A tie bar as set forth in claim 9 wherein said compressible fluid is pressurized and said pneumatic system further includes means for adjusting the pressure of said compressible fluid.

11. A marine propulsion system comprising first and second drive shaft housings which are pivotable about a horizontal axis and about respective spaced vertical axes, and which include respective sides, first and second tilting means respectively connected to said first and second drive shaft housings for pivoting the connected drive shaft housings about the horizontal axis, steering means for pivoting said drive shaft housings about the vertical axes, and a tie bar including opposite ends respectively connected to said drive shaft housing sides, and means for affording axial tie bar extension in response to actuation of only one of said first and second tilting means and for preventing axial extension of said tie bar upon actuation of said steering means.

12. A marine propulsion system as set forth in claim 11 wherein said tie bar further includes length adjustment means for selectively varying the axial length of said tie bar.

13. A marine propulsion system as set forth in claim 11 wherein said means for affording and preventing axial extension comprises a mechanical system having an extendible spring with a constant spring rate.

14. A marine propulsion system as set forth in claim 13 wherein the force needed to extend said spring is greater than the force exerted by the actuation of said steering means and less than the force exerted by the actuation of one of said tilting means.

15. A marine propulosion system as set forth in claim 14 and further comprising spring rate adjustment means for selectively adjusting the spring rate.

16. A marine propulsion system comprising first and second drive units which are pivotable about a horizontal axis and about respective paced vertical axes, first and second tilting means respectively connected to said first and second drive units for pivoting the connected drive unit about the horizontal axis, steering means for pivoting said drive units about the vertical axes, and a tie bar including means for affording axial tie bar extension in response to actuation of only one of said first and second tilting means and for preventing axial extension of said tie bar upon actuation of said steering means, said means for affording and preventing axial extension comprising a hydraulic system containing an incompressible fluid and including a cylinder having therein a piston dividing said cylinder into two chambers, and rotary valve means for affording flow of incompressible fluid from one of said chambers to the other of said chambers in response to relative rotation between said piston and said cylinder.

17. A marine propulsion system as set forth in claim 16 wherein said first and second tilting means each comprises a hydraulic cylinder.

18. A marine propulsion system as set forth in claim 17 wherein said steering means includes a tiller arm connected to each of said drive units and means for moving said tiller arms.

19. A marine propulsion system as set forth in claim 18 wherein the force exerted by the actuation of each tilting means is greater than the force exerted by the steering means.

20. A marine propulsion system comprising first and second drive units which are pivotable about a horizontal axis and about respective spaced vertical axes, first and second tilting means respectively connected to said first and second drive units for pivoting the connected drive unit about the horizontal axis, steering means for pivoting said drive units about the vertical axes, and a tie bar including means for affordidng axial tie bar extension in response to actuation of only one of said first and second tilting means and for preventing axial extension of said tie bar upon actuation of said steering means, said means for affording and preventing axial extension comprising a pneumatic system containin a compressible fluid and comprising a cylinder having therein a piston dividing said cylinder into two chambers, with one of said chambers containing compressible fluid.

21. A marine propulosion system as set forth in claim 20 wherein the force exerted on the piston by the compressible fluid is greater than the force exerted by the actuation of said steering means and less than the force exerted by the actuation of one of said tilting means.

22. A marine propulsion system as set forth in claim 21 and further comprising means for selectively adjusting the force exerted on said piston by the compressible fluid.

23. A marine propulsion system comprising first and second drive units which are pivotable about a horizontal axis and about respective spaced vertical axes, first and second tilting means respectively connected to said first and second drive units for pivoting the connected drive unit about the horizontal axis, steering means for pivoting said drive units about the vertical axes, and a tie bar including means for affording axial tie bar extension in response to actuation of only one of said first and second tilting means and for preventing axial extension of said tie bar upon actuation of said steering means, said means for affording and preventing axial extension comprising a hydraulic system containing an incompressible fluid and including a cylinder having therein a piston dividing said cylinder into two chambers, said hydraulic system also including a relief valve affording flow of said incompressible fluid from one of said chambers to the other of said chambers upon application to said tie rod of a force above a predetermined amount.

24. A marine propulsion system as set forth in claim 23 wherein said predetermined force is greater than the axial force normally exerted on said tie bar by the actuation of said steering means and is less than the axial force exerted in said tie bar by the actuation of one of said tilting means.

* * * * *